United States Patent [19]

Sherman et al.

[11] 4,277,926

[45] Jul. 14, 1981

[54] VENTED INSULATION SYSTEM FOR EXISTING STRUCTURE

[75] Inventors: Morton Sherman; James A. Berry, both of St. Petersburg, Fla.

[73] Assignee: The Celotex Corporation, Tampa, Fla.

[21] Appl. No.: 43,871

[22] Filed: May 30, 1979

[51] Int. Cl.[3] ..... E04B 1/70

[52] U.S. Cl. ..... 52/303; 52/404; 52/408

[58] Field of Search ..... 52/303, 302, 305, 404, 52/408, 741, 508, 407; 98/31

[56] References Cited

U.S. PATENT DOCUMENTS

| | | | |
|---|---|---|---|
| 2,264,961 | 12/1941 | Ward . | |
| 2,318,820 | 5/1943 | Voight et al. . | |
| 2,574,076 | 11/1951 | Westphal | 52/404 |
| 3,204,379 | 9/1965 | Osborn | 52/303 X |
| 3,318,056 | 5/1967 | Thompson | 52/508 X |
| 4,129,972 | 12/1978 | Sherman et al. | 52/303 |

*Primary Examiner*—Carl D. Friedman

[57] ABSTRACT

An insulating wall structure for installation over an existing outer wall of a structure comprises an insulating material spaced from said outer wall with a closure means at the bottom and sides of said outer wall and an opening adjacent the top of said insulating wall structure.

99 Claims, 6 Drawing Figures

FIG. 1
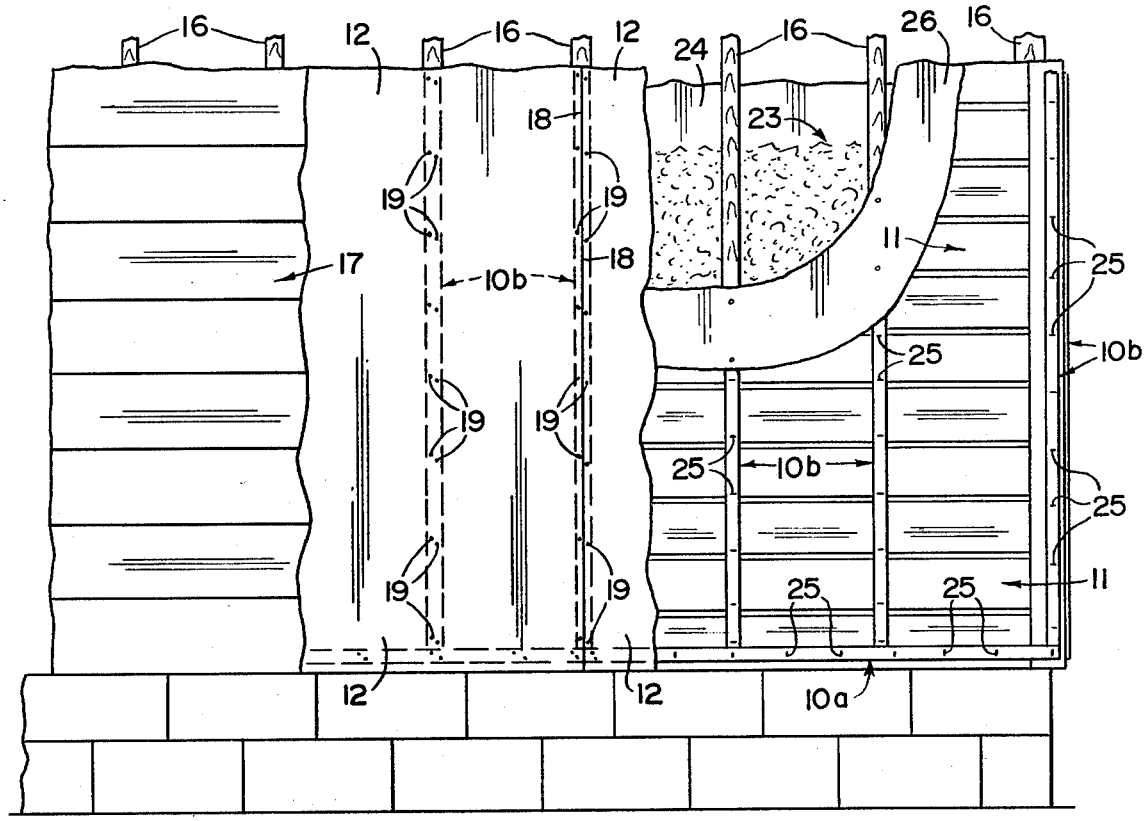
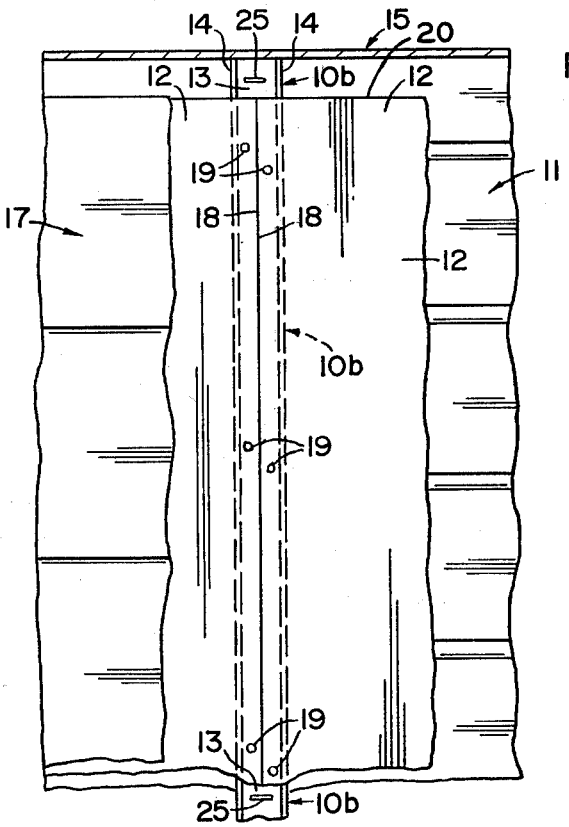
FIG. 2
FIG. 3
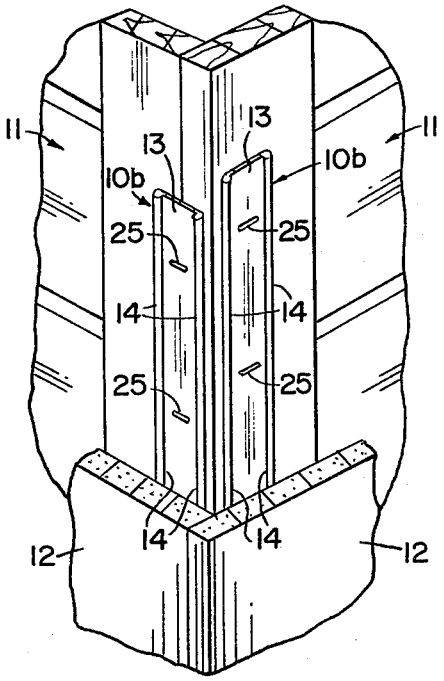

VENTED INSULATION SYSTEM FOR EXISTING STRUCTURE

BACKGROUND OF THE INVENTION

1. Field of the Invention

This invention is directed to an insulating wall structure for application to an existing wall structure, especially to wood-frame construction.

2. Description of the Prior Art

There is a need to better thermally insulate the exterior wall structures of existing buildings in these times of diminishing and ever more costly energy resources. The escalation of energy costs in recent years has been accompanied by increased concern on the part of home owners, builders and utility companies for economical, high efficiency thermal insulation systems, particularly for wood frame residential construction. One increasingly accepted insulation system developed to meet this need involves an exterior retrofitting method, i.e., the residing of an existing wall structure, with a thermal insulating material being disposed between the existing and new siding.

One problem which can arise from the application of this type of retrofit insulation to existing frame walls is that, where the insulation applied is impermeable, it may promote moisture accumulation within the existing or old section of the retrofitted composite. On the other hand, where the new insulation is permeable, there is also the possibility that under severe winter conditions it may also promote moisture or frost and ice accumulation in the new retrofit section of the composite wall. Either situation could result in the risk of premature deterioration.

One prior art method of moisture relief involves cold air wash venting in which a positive air flow is provided by installing a ventilating structure at both the top and bottom of the wall. This method is thermally inadequate since it introduces cold outside air to the "warm" side of the retrofitted insulation material, thus negating the insulating value provided by the retrofitted insulation material.

In U.S. Pat. No. 4,129,972 there is disclosed an insulating wall system for new construction in which heat flow through a wall is inhibited by thermal insulation materials within two spaced moisture- and air-impermeable barriers. A cold air wash is prevented in this wall structure by means of a moisture- and air-impermeable seal at its bottom. Only the top of the structure is kept open to permit the relief of what little moisture might enter therein. The novel wall system disclosed in U.S. Pat. No. 4,129,972 can thus be likened to a large dimensional bottle in which only the top has an uninsulated opening while the rest of the bottle is substantially resistant to heat and moisture flow. While this disclosed wall structure serves to increase the insulating efficiency of the opaque walls of new buildings and to limit moisture entry into these walls, it is not necessarily designed for application to existing buildings where the existing opaque walls may already be established with lesser degrees of moisture and air permeability. Furthermore, total reconstruction of existing walls in accordance with the patent would not be a realistic economic option.

OBJECTS OF THE INVENTION

It is therefore an object of the present invention to provide an improved insulated wall system which is designed for application to the exterior side of an existing wall structure, to both improve its thermal insulating efficiency and provide top-only venting for the relief of moisture vapor therefrom.

It is a further object of the present invention to provide for installation on the exterior side of an existing wall structure of an improved wall system which includes an insulation board sheathing mounted on the existing wall structure, new siding mounted exteriorily to the added insulation board sheathing, and a system of spacers secured between the existing wall structure and the added insulation board sheathing to provide a closure at the bottom and release exit only at the top of the system for moisture vapor that would otherwise become entrapped at the interface of the existing wall structure and the insulation board sheathing.

It is a still further object of the present invention to provide, in an improved wall system which includes an insulation board sheathing for application to the exterior side of an existing wall structure and new siding mounted exteriorily to the insulation board sheathing, moisture relief of the meeting faces of the insulation board sheathing and the existing wall structure by utilizing vent strips as spacers which have a simple and inexpensive design and can be easily accommodated and installed in the wall system.

Other objects and advantages of the present invention will become apparent to those skilled in the art when the instant disclosure is read in conjunction with the accompanying drawings in which like numerals indicate like elements.

SUMMARY OF THE INVENTION

This invention is directed to an insulated wall structure designed for installation on the exterior side of an existing wall assembly and provided with top-only, cold-side venting for the release of moisture vapor. The present invention involves the addition of a highly efficient, thermal insulation layer (sheathing) to the outside of the existing (old) siding, spacing means for separating the insulation layer from the existing siding, closure means for closing off along the bottom and the side edges of the space between the separated insulation layer and existing siding, with an opening being provided for the relief of water vapor. Where necessary for exterior weathering requirements not provided by the new thermal insulation layer, new siding may be mounted against the exterior surface of the insulation layer. It has been discovered that a highly satisfactory venting of water vapor can be achieved from the interface of the old siding and added insulation layer in the assembled wall developed in accordance with the present invention, even where this structure contains barriers having less than the substantially moisture- and air-impervious characteristics required in U.S. Pat. No. 4,129,972. The system of the present invention is thus available for the economic thermal insulation retrofitting of existing building wall structures, and especially of wood frame construction.

The present invention advantageously provides for the installation of a network of spacer or vent strips at the interface between the existing siding and the added insulation layer. The top-venting network of spacer strips comprises closure strips disposed adjacent the bottom edges of the lower portions of the existing siding and extending horizontally along said lower portions and a series of spacer strips disposed in parallel spaced relation and extending vertically upward from said horizontal closure strips to the top edges of the upper portions of said existing siding. The spacer strips are arranged so as to allow moisture relief out the top only of the wall structure of the invention.

Use of the insulated wall structure of the invention makes it possible to retrofit an existing wall structure for improvement of its thermal insulation effectiveness, with less risk of exposing the retrofitted structure to the hazard of premature deterioration from harmful moisture buildup. Its use is particularly recommended whenever existing wood frame walls are retrofitted with a thermal insulation material which is capable of interfering with the passage of moisture. The retrofitting system of the invention can also be beneficial for the relief of moisture where less than perfectly impermeable new insulation sheathing material is added and excessive moisture accumulation can be encountered at the old siding/new insulation layer interface, as where the geographical location of the building experiences an average January temperature of 35° F. or less, or more than 4,000 degree days of winter exposure.

The insulated wall structure of the invention, which is a combination of insulation material, however surfaced, and a weather-proof exterior barrier, should have resistance to air and moisture penetration sufficient so that an air wash is avoided. An air wash occurs when outside air flows into the wall either through bottom openings in the wall or through the wall structure itself. While a limited amount of permeability can be tolerated in the insulated structure, the overall result should be such that the top venting only feature is predominantly effective.

Existing walls with supplemental thermal insulation material within the stud space cavities have a greater tendency towards the development of critical moisture condensation levels within the wall assembly, particularly in areas having relatively severe winter conditions. Accordingly, when existing wall cavities contain permeable thermal insulation and the warm side of the wall has no vapor barrier or an inadequate vapor barrier, such as side-stapled, flanged paper-faced batts, the quantities of moisture available for entry into and accumulation within the wall structure are greatest, and the benefits of this invention most useful. It is, however, recognized good engineering practice and preferable, that an effective resistance to the entry of moisture vapor be present on the warm side of the wall and that wall joints and wall penetrations also be properly sealed, in order to limit and reduce the quantity of moisture to be dealt with.

DESCRIPTION OF THE DRAWINGS

In the drawings:

FIG. 1 is a fragmentary elevational view of a bottom portion of a frame wall structure illustrating its retrofitting in accordance with this invention, with portions broken away to show the internal construction of the structure;

FIG. 2 is a fragmentary elevational view of an upper portion of a frame wall structure illustrating its retrofitting in accordance with this invention, with portions broken away to show the internal construction of the structure;

FIG. 3 is an elevational view of a corner portion of a frame wall structure of the invention with elements of the structure exposed;

DETAILED DESCRIPTION OF THE INVENTION

Figure 4:
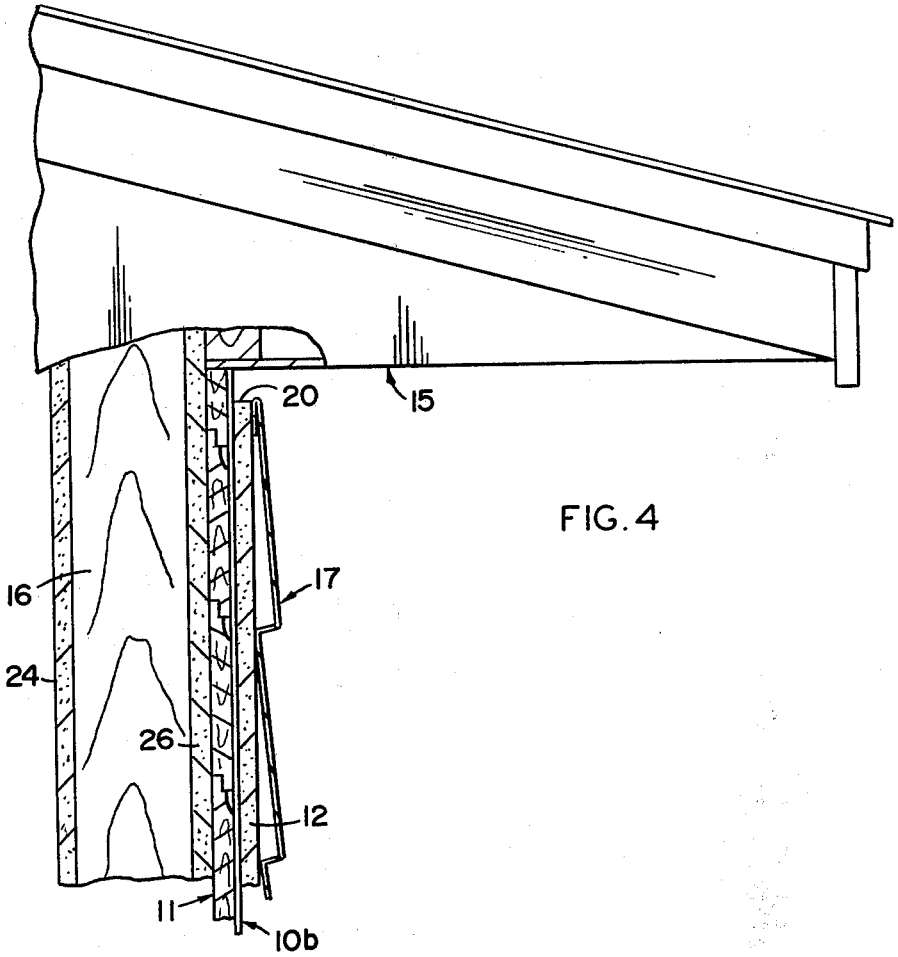
FIG. 4 is a vertical section of the top portion of the frame wall structure shown in FIG. 2.

This invention will be described as embodied in a retrofitted wall structure constructed with the arrangement of the parts as illustrated in FIGS. 1–5. The insulating and residing system of the invention is especially useful in retrofitting residential wood-frame wall construction. It is to be understood, however, that the dimensions, arrangement and assembly of the parts shown in this typical construction could be changed in various ways, and the concept of the invention would still be effective in providing top-only, cold side venting of existing wall structures.

Referring now to the drawings, FIGS. 1 and 2 furnish views showing the installation of the wall system of the invention at the bottom and upper sections, respectively, of an existing wall of a building.

FIG. 1 shows spacer members and closure strips 10*a, b,* attached to the outside surface of old siding 11. A rigid thermal insulating material 12 is attached over spacer members 10*a, b.* A sheathing material 26 may be present in the existing wall between vertical studs 16 and siding 11. The spacer members of the invention can have any convenient shape that accomplishes the purpose of spacing thermal insulating material 12 from old siding 11 or of providing for the closure of the space between the bottom edges or the side edges of insulating material 12 and old siding 11, or that accomplishes both spacing and closure purposes.

A suitable arrangement of spacer members 10*a, b,* to accomplish these purposes is to have one such member aligned horizontally on the outside face of old siding 11 along its bottom edge and a series of further spacer members being spaced apart and extending vertically upward from said horizontally disposed member to terminate at the top of the old siding. In the partial view shown in FIG. 1, the four vertically disposed members 10*b* project upwardly from and are disposed perpendicularly to lower horizontal member 10*a.* Spacer members 10*b* do not have to create a seal between old siding 11 and new insulating material 12 except at the side edges of the space created between the old siding 11 and the new insulating material 12. For example, a lateral air flow well can be present along the gap between spacer members 10*b* and ordinary lap siding.

Spacer strips 10*a, b* can be formed of any suitable material but, for various reasons, including ease of manufacture and installation, and cost, are preferably formed of plastic. The strips advantageously comprise a flexible extruded plastic material, such as polyethylene, polypropylene or polyvinyl chloride, preferably polyethylene. Of course, wood lath strips or metal strips can also be used as spacer strips 10*a,* 10*b.*

Figure 6:
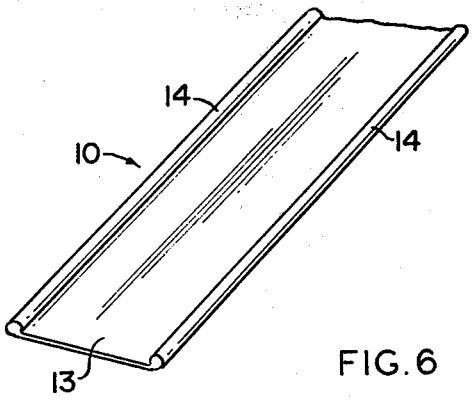
FIG. 6 is a perspective view of one type of spacer member or closure strip of the invention.

As can be seen in FIGS. 1, 3 and 6, each of the spacer members 10*a, b* advantageously comprises a long, narrow piece of plastic having a thin, central portion or web 13 and its two lengthwise edges thickened to form edge beads 14, which have a roughly circular shape. By way of example, the approximate dimensions of each spacer member 10*a, b* can be as follows: overall width, 1.10 in.; web width, 0.86 in.; web thickness, 0.02 in.; and edge bead diameter, 0.12 in. The lengths of spacer members 10*a, b* can, of course, vary depending on the horizontal and vertical lengths of the existing siding sections to which said spacer members are attached.

Before the exterior retrofitting of a building is started good construction practice requires that all mechanical and/or moisture problems in the existing wall system be corrected. The existing old exterior siding should be placed in reasonably sound mechanical condition. Typical preliminary problems to be corrected include those which cause paint peeling, blistering, cracking, etc.; moisture stain, mildew, decay of siding, trim, sills, corner posts, etc.; detached, warped or buckled siding, trim, etc.; gross moisture penetration into the wall system such as: leaky roofing or siding, defective gutters and downspouts, inadequate caulking, large wall openings, wall damage, inadequate interior ventilation, etc. Gutters, downspouts and shutters should preferably be removed for later reinstallation, so that they do not obstruct the retrofitting operation. Furthermore, attic and crawl space ventilation should also be made satisfactory before installation of the energy-saving wall system of the invention.

After completion of any necessary corrective measures in the existing wall structure, the closure strips 10*a* are applied to all exterior walls by stapling, nailing or otherwise fastening them (through web 13) by fasteners 25 horizontally to the bottom course or panel of existing siding 11 and over the tops of doors and windows. While FIG. 1 illustrates installation only on a bottom wall section, the installation on siding over doors and windows is entirely analogous. One long closure strip or a number of abutting closure strips can be run along the bottom of the existing siding of each wall section. Advantageously, the width of closure strip web 13 is such that a channel is provided to accept the width of a conventional hand staple gun. Spacer strips 10*b* are next applied vertically by similar fastening means so as to run from each of the horizontal spacer strips 10*a* to the juncture of existing siding 11 and existing soffit 15 (see FIG. 4). Installation of closure strips 10*a* begins at the corner of the building and progresses with the spacer strips being positioned as nearly as possible in alignment with the existing stud framing 16. Preferably, spacer strips 10*b* are centered over the existing vertical studs 16 at the conventional 16 inch centers (see FIG. 1).

Thermal insulating material 12 is next secured over the installed spacer strips. Thermal insulating material 12 can advantageously comprise a rigid foam plastic thermal insulation board which is nailed or otherwise secured as a sheathing to form an insulating layer between old siding 11 and the outside new siding 17, as necessary for weathering requirements not otherwise provided by the new thermal insulation layer (see FIG. 1). A foam plastic thermal insulation board, with vapor barrier characteristics, i.e., with a permeance of less than 1 perm and thus capable of interfering with the passage of moisture, is suitable for implementing this invention. The preferred foam plastic thermal insulation board 12 is a product made with a polyurethane or polyisocyanurate foam core with metal sheet facers. These facers may be aluminum adhered to the face of the foam core during the process of manufacture. The aluminum facers can act as heat reflective surfaces and as liquid or gas barriers, since the metal sheets will not permit fluids to penetrate. A suitable foam plastic thermal insulation board is one made by The Celotex Corporation of Tampa, Florida under the designation Energy Saving General Purpose Insulation Board (TF-400). Typical thermal insulation board dimensions are 4 feet×8 feet and 4 feet×9 feet, although longer length boards may also be used to implement this invention. Other insulating materials which can be used include surfaced semi-rigid blanket thermal insulation and surfaced rigid cellulosic fiber board. In all cases, the combination of insulation material, however surfaced, and its exterior weatherproof barrier should have sufficient air and moisture impermeability to avoid airwash effects and ensure a satisfactory relief of moisture vapor through the top vent of the insulated wall structure of the invention.

FIGS. 1 and 2 illustrate an advantageous method of securing the new insulation sheathing to the existing wall structure in accordance with the present invention. Insulation boards 12 are positioned so that their side vertical edge portions and lower horizontal edge portions extend over spacer strips 10*b* and 10*a*, respectively. For a given wall section, adjacent thermal insulation boards are secured with edges 18 abutting each other along a plane extending perpendicularly through the center of strip web 13 (See FIGS. 1 and 2). In the typical case, with an insulation board 12 which is four feet in width and studs 16 spaced on conventional 16 inch centers, the board would extend from the center of one spacer strip to the center of another located three strips away. Boards 12 are stapled, nailed or otherwise secured by mechanical fasteners 19 driven through them and spacer strips 10*a* and 10*b* into the wall structure. As illustrated in FIGS. 1 and 2 each insulation board 12 is secured in place by a number of fasteners 19 disposed at a short distance, as, e.g., ½ inch to ⅝ inch, from the sheathing vertical side and horizontal lower edges. The fasteners are applied a suitable distance apart, as, e.g., 8 inches on center, or so as to penetrate into the lower portion of each course of siding. As shown in FIG. 2, the side fasteners of adjacent boards 12 are preferentially secured in a staggered arrangement, with the adjacent fasteners of the two boards being horizontally off line from each other. No fasteners are inserted between spacer strips 10*b* along the sheathing's horizontal upper edge 20, which lies adjacent the juncture of old siding 11 and soffit 15 (See FIG. 4).

Figure 5:
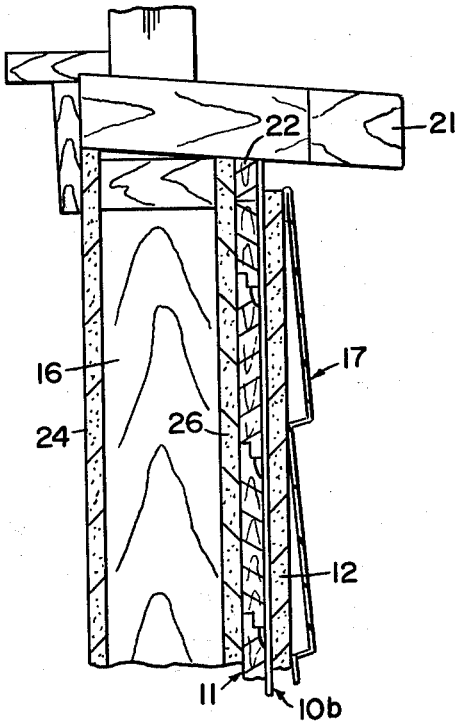
FIG. 5 is a vertical section of a portion of a frame wall structure under a window sill illustrating its retrofitting in accordance with this invention.

The insulation sheathing 12 is installed as depicted in FIG. 4 so that spacing is provided between its upper edge 20 and the overlying building structure, as e.g., soffit 15, to furnish an adequate moisture vapor relief exit. This spacing is maintained at all building wall and soffit junctures. Advantageously, such spacing is no less than ¼ inch. FIG. 5 illustrates a method of providing for the venting of moisture vapor under windows, which utilizes a window sill extender 21 to provide, where necessary, for a protective overhang and a furring strip 22 for additional support of the wall structure of the invention, if required.

Variations in the venting system of the invention may be necessary depending on the characteristics of each existing wall system. The new insulation sheathing and spacer strips are to be applied so as to provide vapor relief which must not be blocked off. On the other hand, new siding must be installed in a manner that will prevent ingress of rain water. This is particularly important at the rakes of gables where there is no roof overhang. A reliable flashing system to deflect water beyond the new siding should be used in these situations. This may involve the construction of special channeling for the passage of moisture vapor to the outside of the building after it is vented from the top of the cavity formed by the new insulation sheathing and spacer strips of the invention. Also, a new vented (perforated) soffit can be installed on the building and spacer strips 10*b* and sheathing 12 can then both be extended up into the new soffit area. But here too a vent opening is still provided between the top edge of new sheathing 12 and the existing wall structure.

When used, new exterior siding 17 is secured in a conventional manner on the outside of sheathing 12. The securing fasteners must be long enough to penetrate through the insulation sheathing and underlying spacer strips to a suitable depth in the securing substrate. In the application of the new siding care must be taken to avoid any blockage of the underlying venting cavities. For example, the top edge of the new siding 17 should be no less than ¼ inch below soffit 15 so as not to block or seal the vent exit at the soffit and wall juncture (See FIG. 4).

Siding 17 may be wood, hardboard, brick, aluminum, vinyl, or other conventional exterior covering for the building. A typical exterior siding may be hardboard siding sold by The Celotex Corporation of Tampa, Florida, under the trademark "Shadowcast". It is a reconstituted wood product made from wood fibers with a suitable binder in a hot press.

The retrofitting wall system of the invention can be utilized in geographical areas where there is history of moisture problems in frame wall systems. Although the retrofitting system of the invention would probably not be required for condensation control in areas experiencing 4,000 degree days or less of winter exposure, the spacer strips may nevertheless have utility as a leveling base for residing.

Where the existing structure is located in an area experiencing more than 2,000 degree days of winter exposure and the existing stud cavities contain a permeable thermal insulation material 23, it is preferred that the existing wall be equipped with a vapor barrier 24 (see FIG. 1) on the "warm" or interior side (room side) if one does not already exist. A satisfactory vapor barrier material is composed of foil backed by a supporting material, such as thin aluminum foil laminated to gypsum wallboard. Other useful vapor barriers include: kraft or foil facer on batt insulation installed with their flanges lapped over the studs; two or more coats of oil base paint; specially formulated vapor barrier paint systems; plastic film-faced wallpaper; etc.

Whereas the present invention has been described with respect to specific embodiments thereof, it should be understood that the invention is not limited thereto as many modifications thereof may be made. It is, therefore, contemplated to cover by the present application any and all such modifications as fall within the true spirit and scope of the appended claims.

We claim:

1. An insulating wall structure for installation onto an existing wall of a structure comprising a layer of insulating material mounted adjacent the exterior surface of said existing wall, spacing means for separating said layer of insulating material from said existing wall, and closure means for closing off along the bottom and the side edges of the space between said separated layer of insulating material and existing wall, an opening being provided at the upper edge of said insulating wall structure so as to provide a relief outlet for water vapor from the interface of said existing wall and said insulating wall structure to the outside of said structure.

2. The wall structure of claim 1 wherein the insulating material has a major surface covered with a substantially moisture- and air-impervious sheet.

3. The wall structure of claim 1 wherein the insulating material has a major surface covered with a substantially moisture- and air-impervious coating.

4. The wall structure of claims 2 or 3 wherein the exterior surface of the insulating material comprises a weatherproof barrier.

5. The wall structure of claims 2 or 3 wherein weatherproof siding is mounted against the exterior surface of the insulating material.

6. The wall structure of claim 1 wherein both sides of the insulating material are covered with a substantially moisture- and air-impervious sheet.

7. The wall structure of claim 1 wherein both sides of the insulating material are covered with a substantially moisture- and air-impervious coating.

8. The wall structure of claims 6 or 7 wherein the exterior surface of the insulating material comprises a weatherproof barrier.

9. The wall structure of claims 6 or 7 wherein weatherproof siding is mounted against the exterior surface of the insulating material.

10. The wall structure of claim 1 wherein the existing wall is equipped with a vapor barrier on its interior side.

11. The wall structure of claim 10 wherein the vapor barrier is coated plaster.

12. The wall structure of claim 10 wherein the vapor barrier is wallboard laminated on one side with plastic film.

13. The wall structure of claim 10 wherein the vapor barrier is wallboard laminated on one side with aluminum foil.

14. The wall structure of claim 10 wherein the vapor barrier is vapor transmission-resistant paint.

15. The wall structure of claim 10 wherein the vapor barrier is a flexible sheet.

16. The wall structure of claim 15 wherein the flexible sheet is polyethylene film.

17. The wall structure of claim 15 wherein the flexible sheet is supported aluminum foil.

18. The wall structure of claim 15 wherein the flexible sheet is unsupported aluminum foil.

19. The wall structure of claim 15 wherein the flexible sheet is plastic coated paper.

20. The wall structure of claim 1 wherein the insulating material is thermal insulation board.

21. The wall structure of claim 1 wherein the insulating material is surfaced semi-rigid blanket thermal insulation.

22. The wall structure of claims 20 or 21 wherein the insulating material has a major surface covered with a substantially moisture- and air-impervious sheet.

23. The wall structure of claim 22 wherein the exterior surface of the insulating material comprises a weatherproof barrier.

24. The wall structure of claim 22 wherein the weatherproof siding is mounted against the exterior surface of the insulating material.

25. The wall structure of claims 20 or 21 wherein the insulating material has a major surface covered with a substantially moisture- and air-impervious coating.

26. The wall structure of claim 25 wherein the exterior surface of the insulating material comprises a weatherproof barrier.

27. The wall structure of claim 26 wherein weatherproof siding is mounted against the exterior surface of the insulating material.

28. The wall structure of claims 20 or 21 wherein both sides of the insulating material are covered with a substantially moisture- and air-impervious sheet.

29. The wall structure of claim 28 wherein the exterior surface of the insulating material comprises a weatherproof barrier.

30. The wall structure of claim 28 wherein weatherproof siding is mounted against the exterior surface of the insulating material.

31. The wall structure of claims 20 or 21 wherein both sides of the insulating material are covered with a substantially moisture- and air-impervious coating.

32. The wall structure of claim 31 wherein the exterior surface of the insulating material comprises a weatherproof barrier.

33. The wall structure of claim 31 wherein weatherproof siding is mounted against the exterior surface of the insulating material.

34. The wall structure of claims 20 or 21 wherein the existing wall is equipped with a vapor barrier on its interior side.

35. The wall structure of claim 34 wherein the vapor barrier is coated plaster.

36. The wall structure of claim 34 wherein the vapor barrier is wallboard laminated on one side with plastic film.

37. The wall structure of claim 34 wherein the vapor barrier is wallboard laminated on one side with aluminum foil.

38. The wall structure of claim 34 wherein the vapor barrier is vapor transmission-resistant paint.

39. The wall structure of claim 34 wherein the vapor barrier is a flexible sheet.

40. The wall structure of claim 39 wherein the flexible sheet is polyethylene film.

41. The wall structure of claim 39 wherein the flexible sheet is supported aluminum foil.

42. The wall structure of claim 39 wherein the flexible sheet is unsupported aluminum foil.

43. The wall structure of claim 39 wherein the flexible sheet is plastic coated paper.

44. The wall structure of claim 1 wherein the insulating material is surfaced rigid cellulosic fiber board.

45. The wall structure of claim 1 wherein the insulating material is a plastic foam insulation material.

46. The wall structure of claims 44 or 45 wherein the insulating material has a major surface covered with a substantially moisture- and air-impervious sheet.

47. The wall structure of claims 44 or 45 wherein the insulating material has a major surface covered with a substantially moisture- and air-impervious coating.

48. The wall structure of claims 44 or 45 wherein both sides of the thermal insulation board are covered with a substantially moisture- and air-impervious sheet.

49. The wall structure of claims 44 or 45 wherein both sides of the thermal insulation board are covered with a substantially moisture- and air-impervious coating.

50. The wall structure of claim 45 wherein the plastic foam insulation material comprises a glass-reinforced polyisocyanurate foam plastic core with aluminum foil facers.

51. The wall structure of claim 1 wherein a system of spacers is secured between said existing wall and said layer of insulating material, said system of spacers comprising a closure spacer disposed adjacent the bottom edges of the lower portions of said exterior wall surface and extending horizontally along said lower portions to provide a substantially air- and moisture-impervious seal along said lower portions, and closure spacers disposed at the side edges of said exterior wall surface and extending vertically along said side edges to provide a substantially air- and moisture-impervious seal along said side edges, and a series of spacers disposed in parallel spaced relation between the one side edge of said existing wall and its other side edge and extending vertically upward from the horizontal bottom closure spacer to the top edges of the upper portions of said exterior wall surface.

52. The wall structure of claim 51 wherein the insulating material has a major surface covered with a substantially moisture- and air-impervious sheet.

53. The wall structure of claim 51 wherein the insulating material has a major surface covered with a substantially moisture- and air-impervious coating.

54. The wall structure of claims 52 or 53 wherein the exterior surface of the insulating material comprises a weatherproof barrier.

55. The wall structure of claims 52 or 53 wherein weatherproof siding is mounted against the exterior surface of the insulating material.

56. The wall structure of claim 51 wherein both sides of the insulating material are covered with a substantially moisture- and air-impervious sheet.

57. The wall structure of claim 51 wherein both sides of the insulating material are covered with a substantially moisture- and air-impervious coating.

58. The wall structure of claims 56 or 57 wherein the exterior surface of the insulating material comprises a weatherproof barrier.

59. The wall structure of claims 56 or 57 wherein weatherproof siding is mounted against the exterior surface of the insulating material.

60. The wall structure of claim 51 wherein the insulating material is thermal insulation board.

61. The wall structure of claim 51 wherein the insulating material is surfaced semi-rigid blanket thermal insulation.

62. The wall structure of claims 60 or 61 wherein the insulating material has a major surface covered with a substantially moisture- and air-impervious sheet.

63. The wall structure of claim 62 wherein the exterior surface of the insulating material comprises a weatherproof barrier.

64. The wall structure of claim 62 wherein weatherproof siding is mounted against the exterior surface of the insulating material.

65. The wall structure of claims 60 or 61 wherein the insulating material has a major surface covered with a substantially moisture- and air-impervious coating.

66. The wall structure of claim 65 wherein the exterior surface of the insulating material comprises a weatherproof barrier.

67. The wall structure of claim 65 wherein weatherproof siding is mounted against the exterior surface of the insulating material.

68. The wall structure of claims 60 or 61 wherein both sids of the insulating material are covered with a substantially moisture- and air-impervious sheet.

69. The wall structure of claim 68 wherein the exterior surface of the insulating material comprises a weatherproof barrier.

70. The wall structure of claim 68 wherein weatherproof siding is mounted against the exterior surface of the insulating material.

71. The wall structure of claims 60 or 61 wherein both sides of the insulating material are covered with a substantially moisture- and air-impervious coating.

72. The wall structure of claim 71 wherein the exterior surface of the insulating material comprises a weatherproof barrier.

73. The wall structure of claim 71 wherein weatherproof siding is mounted against the exterior surface of the insulating material.

74. The wall structure of claim 51 wherein the insulating material is surfaced rigid cellulosic fiber board.

75. The wall structure of claim 51 wherein the insulating material is a plastic foam insulation material.

76. The wall structure of claims 74 or 75 wherein the insulating material has a major surface covered with a substantially moisture- and air-impervious sheet.

77. The wall structure of claims 74 or 75 wherein the insulating material has a major surface covered with a substantially moisture- and air-impervious coating.

78. The wall structure of claims 74 or 75 wherein both sides of the insulating material are covered with a substantially moisture- and air-impervious sheet.

79. The wall structure of claims 74 or 75 wherein both sides of the insulating material are covered with a substantially moisture- and air-impervious coating.

80. The wall structure of claim 75 wherein the plastic foam insulation material comprises a glass-reinforced polyisocyanurate foam plastic core with aluminum foil facers.

81. The wall structure of claims 51, 60, 61, 74, 75, or 80 wherein the spacers are wood furring strips.

82. The wall structure of claim 51, 60, 61, 74, 75, or 80 wherein the spacers are metal furring strips.

83. The wall structure of claims 51, 60, 61, 74, 75, or 80 wherein the spacers are plastic strips.

84. The wall structure of claim 83 wherein the plastic strips comprise elongated, narrow pieces of plastic having a thin, central portion and their lengthwise edges thickened to form side beads.

85. The wall structure of claim 84 wherein the plastic strips are formed of polyethylene.

86. The wall structure of claim 84 wherein the plastic strips are formed of polypropylene.

87. The wall structure of claim 84 wherein the plastic strips are formed of polyvinyl chloride.

88. The wall structure of claim 84 wherein siding is mounted against the exterior surface of the insulating material.

89. The wall structure of claim 84 wherein the exterior surface of the insulating material comprises a weatherproof barrier.

90. The wall structure of claims 51, 60 or 61 wherein the existing wall is equipped with a vapor barrier on its interior side.

91. The wall structure of claim 90 wherein the vapor barrier is coated plaster.

92. The wall structure of claim 90 wherein the vapor barrier is wallboard laminated on one side with plastic film.

93. The wall structure of claim 90 wherein the vapor barrier is wallboard laminated on one side with aluminum foil.

94. The wall structure of claim 90 wherein the vapor barrier is vapor transmission-resistant paint.

95. The wall structure of claim 90 wherein the vapor barrier is a flexible sheet.

96. The wall structure of claim 95 wherein the flexible sheet is polyethylene film.

97. The wall structure of claim 95 wherein the flexible sheet is supported aluminum foil.

98. The wall structure of claim 95 wherein the flexible sheet is unsupported aluminum foil.

99. The wall structure of claim 95 wherein the flexible sheet is plastic coated paper.

* * * * *